US011033794B2

(12) United States Patent
Tsai

(10) Patent No.: US 11,033,794 B2
(45) Date of Patent: Jun. 15, 2021

(54) OPENABLE EXERCISING DEVICE THAT IS STORED EASILY AND CONVENIENTLY AND IS ADAPTED TO FUNCTION AS FURNITURE

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 0 days.

(21) Appl. No.: 16/458,296

(22) Filed: Jul. 1, 2019

(65) Prior Publication Data

US 2020/0047050 A1 Feb. 13, 2020

(30) Foreign Application Priority Data

Aug. 13, 2018 (TW) ..... 107128157

(51) Int. Cl.

| | |
|---|---|
| ***A63B 71/00*** | (2006.01) |
| ***A63B 22/00*** | (2006.01) |
| ***A63B 22/02*** | (2006.01) |
| ***A63B 22/06*** | (2006.01) |

(52) U.S. Cl.

CPC ..... *A63B 71/0036* (2013.01); *A63B 22/0002* (2013.01); *A63B 22/0056* (2013.01); *A63B 22/02* (2013.01); *A63B 22/0664* (2013.01); *A63B 2210/50* (2013.01)

(58) Field of Classification Search

CPC ..... A47B 88/00; A47B 81/00; A47B 49/00; A47B 49/04; A47B 49/81; A47C 19/00; A47C 16/00; A47C 46/005; A47C 9/002; A47C 7/628; A63B 21/0605; A63B 21/4035; A63B 22/0046; A63B 22/0076; A63B 22/02; A63B 22/0664; A63B 22/0056; A63B 22/0002; A63B 60/56; A63B 60/38; A63B 71/0036; A63B 71/0619; A63B 69/18; A63B 2210/04; A63B 2210/58; A63B 2210/50; B65D 43/18; B65D 43/16

USPC ..... 482/52, 148, 51

See application file for complete search history.

(56) References Cited

U.S. PATENT DOCUMENTS

| | | | | |
|---|---|---|---|---|
| 1,336,774 A * | 4/1920 | Cooper | A61H 33/06 | 4/528 |
| 1,365,460 A * | 1/1921 | Cooper | A61H 33/06 | 4/532 |
| 2,632,645 A * | 3/1953 | Barkschat | A63B 21/0628 | 482/38 |
| 3,738,649 A * | 6/1973 | Miller | A63B 21/04 | 482/57 |

(Continued)

FOREIGN PATENT DOCUMENTS

TW 433218 U 5/2001

*Primary Examiner* — Gary D Urbiel Goldner
*Assistant Examiner* — Thao N Do
(74) *Attorney, Agent, or Firm* — Alan D. Kamrath; Karin L. Williams; Mayer & Williams PC

(57) ABSTRACT

An exercising device includes a base placed on a plane, a cover pivotally connected with the base, and an exercise apparatus mounted between the base and the cover. The cover has a side pivotally mounted on a side of the base. The cover is pivoted relative to the base to open or close a top face of the base. The exercise apparatus includes a leg working unit mounted on the base. Thus, the exercising device is stored easily and conveniently and is adapted to function as furniture. The exercising device also has a dustproof function.

9 Claims, 9 Drawing Sheets

(56) References Cited

U.S. PATENT DOCUMENTS

| | | | | |
|---|---|---|---|---|
| 3,874,657 | A * | 4/1975 | Niebojewski | A63B 22/0002 482/104 |
| 4,344,660 | A * | 8/1982 | Molnar | A63B 55/60 312/249.13 |
| 5,813,947 | A * | 9/1998 | Densmore | A63B 22/205 482/51 |
| 10,434,355 | B1 * | 10/2019 | Kipnis | A63B 21/4031 |
| 2002/0043909 | A1 * | 4/2002 | Nielsen | A47B 85/08 312/237 |
| 2008/0042358 | A1 * | 2/2008 | Chen | G07F 17/38 273/317.3 |
| 2009/0108648 | A1 * | 4/2009 | Biggs | A63B 23/03575 297/217.1 |
| 2009/0181833 | A1 * | 7/2009 | Cassidy | A63B 21/156 482/94 |
| 2013/0231228 | A1 * | 9/2013 | Wyatt | A63B 23/1209 482/130 |
| 2015/0328496 | A1 * | 11/2015 | Eder | A63B 23/12 482/62 |
| 2016/0074698 | A1 * | 3/2016 | Figueroa | A47C 17/38 5/2.1 |
| 2017/0120102 | A1 * | 5/2017 | Chen | A63B 71/0054 |
| 2019/0126122 | A1 * | 5/2019 | Vester | A63B 21/4029 |
| 2019/0166993 | A1 * | 6/2019 | Siaperas | A63B 21/4033 |

* cited by examiner

OPENABLE EXERCISING DEVICE THAT IS STORED EASILY AND CONVENIENTLY AND IS ADAPTED TO FUNCTION AS FURNITURE

BACKGROUND OF THE INVENTION

1. Field of the Invention

The present invention relates to an exercising device and, more particularly, to a box-shaped openable exercising device that is opened upward.

2. Description of the Related Art

A conventional indoor exercising device, such as a treadmill, a step machine, an elliptic exercise machine, an exercise bike or the like is used to provide an exercising effect to the user. However, the conventional exercising device has a determined volume and occupies a larger space, such that it cannot be stored easily, thereby greatly causing inconvenience to the user when not in use. In addition, the conventional exercising device has an outstanding appearance that cannot mate with the indoor appliances of the house. Further, dust easily accumulates on the conventional exercising device during a long period of time.

A conventional cabinet (or cupboard) type treadmill was disclosed in the Taiwanese Patent Publication No. 433218, and comprises a side board that is opened downward to expose the running platform (or board) such that the running platform is placed on the ground to facilitate the user running or walking on the running platform. However, the side board is not opened easily, thereby causing inconvenience to the user when opening or closing the side board.

BRIEF SUMMARY OF THE INVENTION

The primary objective of the present invention is to provide an exercising device that is stored easily and conveniently and is adapted to function as furniture. The exercising device also has a dustproof function.

In accordance with the present invention, there is provided an exercising device comprising a base placed on a plane, a cover pivotally connected with the base, and an exercise apparatus mounted between the base and the cover. The cover has a side pivotally mounted on a side of the base. The cover is pivoted relative to the base to open or close a top face of the base. The exercise apparatus includes a leg working unit mounted on the base.

Preferably, the leg working unit has a platform structure and includes a rotary belt that is rotated on the base.

Alternatively, the leg working unit includes two operation members pivotally connected with the base, and two pedals mounted on the two operation members respectively.

Preferably, the exercise apparatus further includes a hand working unit mounted on the cover and located opposite to the leg working unit. The hand working unit is mounted on an inner face of the cover. The inner face of the cover is provided with a receiving groove, and the hand working unit is mounted in the receiving groove of the cover.

Preferably, the hand working unit and the leg working unit cooperate with each other and are operated mutually.

Alternatively, the exercise apparatus further includes a hand working unit mounted on the base and located beside the leg working unit. The base is provided with a receiving slot located beside the leg working unit, and the hand working unit is mounted in the receiving slot of the base.

Preferably, the exercise apparatus further includes an electronic instrument which is mounted on an inner face of the cover and electrically connected with the leg working unit. The inner face of the cover is provided with a receiving recess, and the electronic instrument is mounted in the receiving recess of the cover.

Preferably, the exercising device further comprises at least one cushion mounted on an outer face of the cover.

According to the primary advantage of the present invention, when the user wishes to use the exercise apparatus, the cover is pivoted outward to expose and unfold the exercise apparatus, such that the user directly operates the exercise apparatus to achieve an exercising effect, and the exercise apparatus does not occupies additional indoor space.

According to another advantage of the present invention, when the exercise apparatus is folded, the at least one cushion is exposed outward after the cover covers the base, such that the exercising device is disposed at a furniture status and functions as a seat or a bed when not in use.

According to a further advantage of the present invention, when the cover closes the top face of the base, the exercise apparatus is covered by the cover, to achieve dustproof and storage functions, and to enhance the lifetime of the exercise apparatus.

According to a further advantage of the present invention, the exercise apparatus is stored easily and conveniently, thereby facilitating the user storing the exercise apparatus.

According to a further advantage of the present invention, the exercising device is adapted to function as furniture, such that the exercising device is incorporated into the house environment, thereby enhancing the aesthetic quality of the house.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
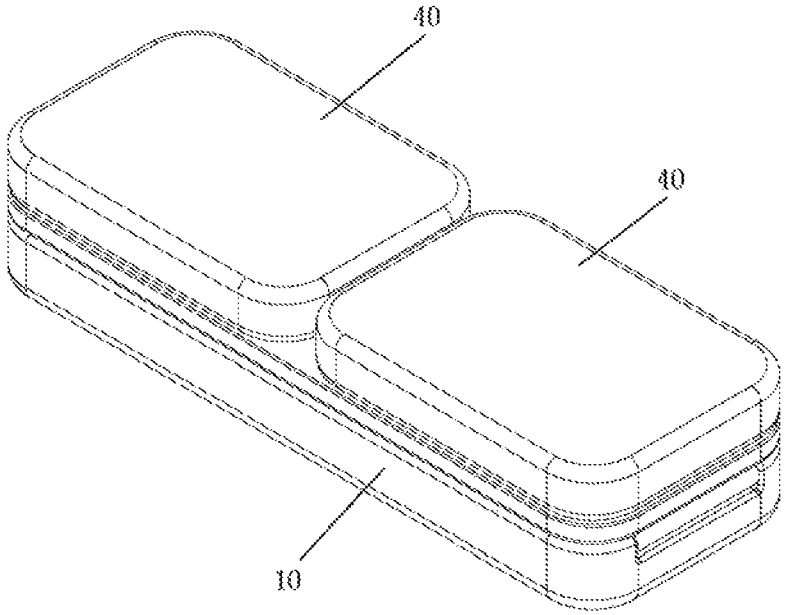
FIG. 1 is a perspective view of an exercising device in accordance with the first preferred embodiment of the present invention.
Figure 2:
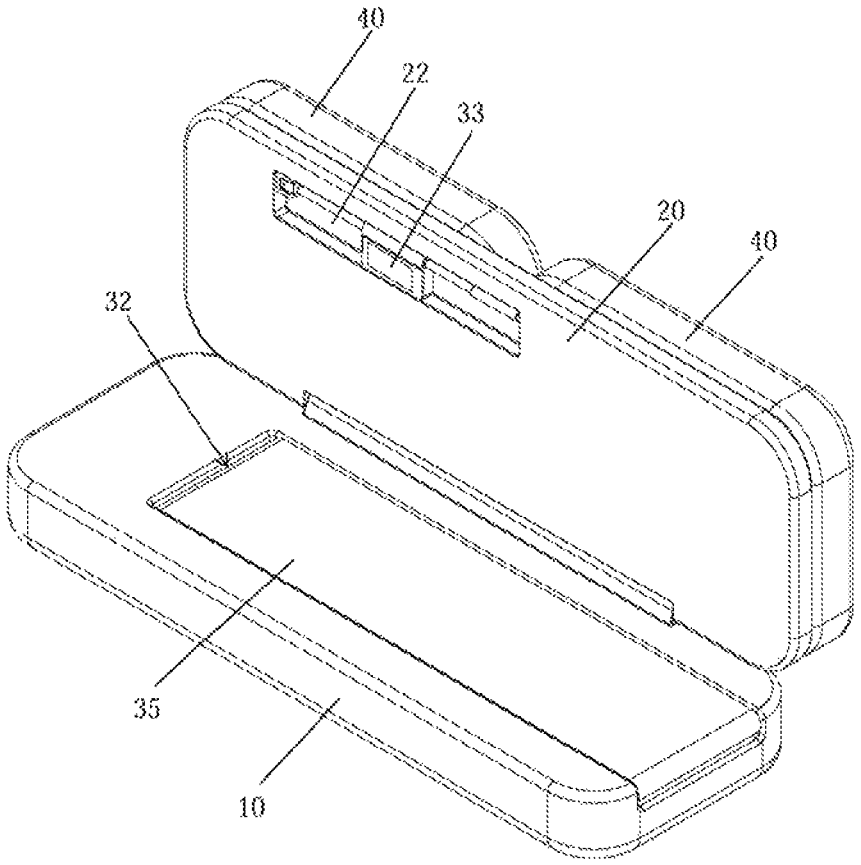
FIG. 2 is a schematic operational view of the exercising device as shown in FIG. 1.
Figure 3:
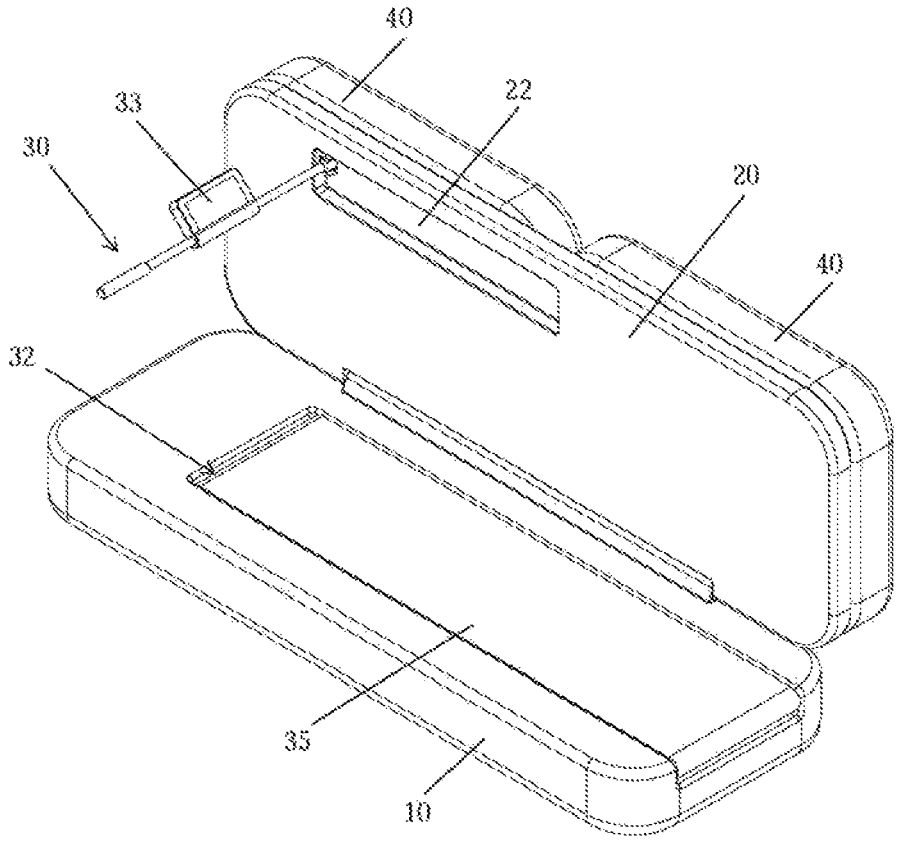
FIG. 3 is a schematic operational view of the exercising device as shown in FIG. 2 in use.

Referring to the drawings and initially to FIGS. 1-3, an exercising device in accordance with the preferred embodiment of the present invention comprises a base 10 placed on a plane, a cover 20 pivotally connected with the base 10, and an exercise apparatus 30 mounted between the base 10 and the cover 20. The cover 20 has a side pivotally mounted on a side of the base 10. The cover 20 is pivoted relative to the base 10 to open or close a top face of the base 10. The exercise apparatus 30 includes a leg working unit 32 mounted on the base 10. Preferably, the bottom face of the base 10 is provided with a stand or a plurality of casters.

In the preferred embodiment of the present invention, the leg working unit 32 has a platform structure and includes a rotary belt 35 that is rotated on the base 10. Thus, the user treads and moves on the rotary belt 35.

In the preferred embodiment of the present invention, the exercise apparatus 30 further includes an electronic instrument 33 which is mounted on an inner face of the cover 20 and electrically connected with the leg working unit 32.

In the preferred embodiment of the present invention, the inner face of the cover 20 is provided with a receiving recess 22, and the electronic instrument 33 is mounted in the receiving recess 22 of the cover 20. The electronic instrument 33 is pivotally connected with the cover 20. The electronic instrument 33 is folded and received in the receiving recess 22 of the cover 20 as shown in FIG. 2, or unfolded and extended outward from the receiving recess 22 of the cover 20 as shown in FIG. 3. Preferably, the electronic instrument 33 is provided with a transverse bar (or grip).

In the preferred embodiment of the present invention, the exercising device further comprises at least one cushion 40 mounted on an outer face of the cover 20.

In the preferred embodiment of the present invention, the base 10 is made of wood, plastics, iron, glass or the like.

In the preferred embodiment of the present invention, the cover 20 is made of wood, plastics, iron, glass or the like.

In operation, referring to FIGS. 2 and 3 with reference to FIG. 1, the cover 20 is pivoted outward from the base 10, to expose the leg working unit 32 and the electronic instrument 33 as shown in FIG. 2. Then, the electronic instrument 33 is unfolded and extended outward from the receiving recess 22 of the cover 20 as shown in FIG. 3. Thus, the user treads and moves on the rotary belt 35 of the leg working unit 32 to achieve an exercising effect. When not in use, the electronic instrument 33 is folded and received in the receiving recess 22 of the cover 20 as shown in FIG. 2. Then, the cover 20 is pivoted toward the base 10, to close the top face of the base 10, such that the leg working unit 32 and the electronic instrument 33 are covered and stored. Thus, the exercise apparatus 30 is folded and stored. In addition, the at least one cushion 40 is exposed outward after the cover 20 covers the base 10 as shown in FIG. 1, such that the exercising device is disposed at a furniture status and functions as a seat or a bed.

Figure 4:
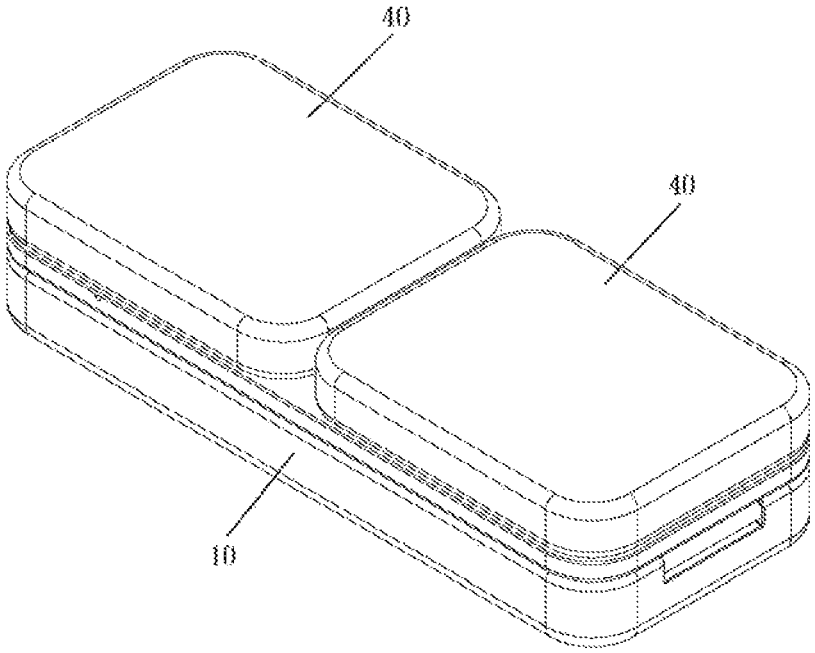
FIG. 4 is a perspective view of an exercising device in accordance with the second preferred embodiment of the present invention.
Figure 5:
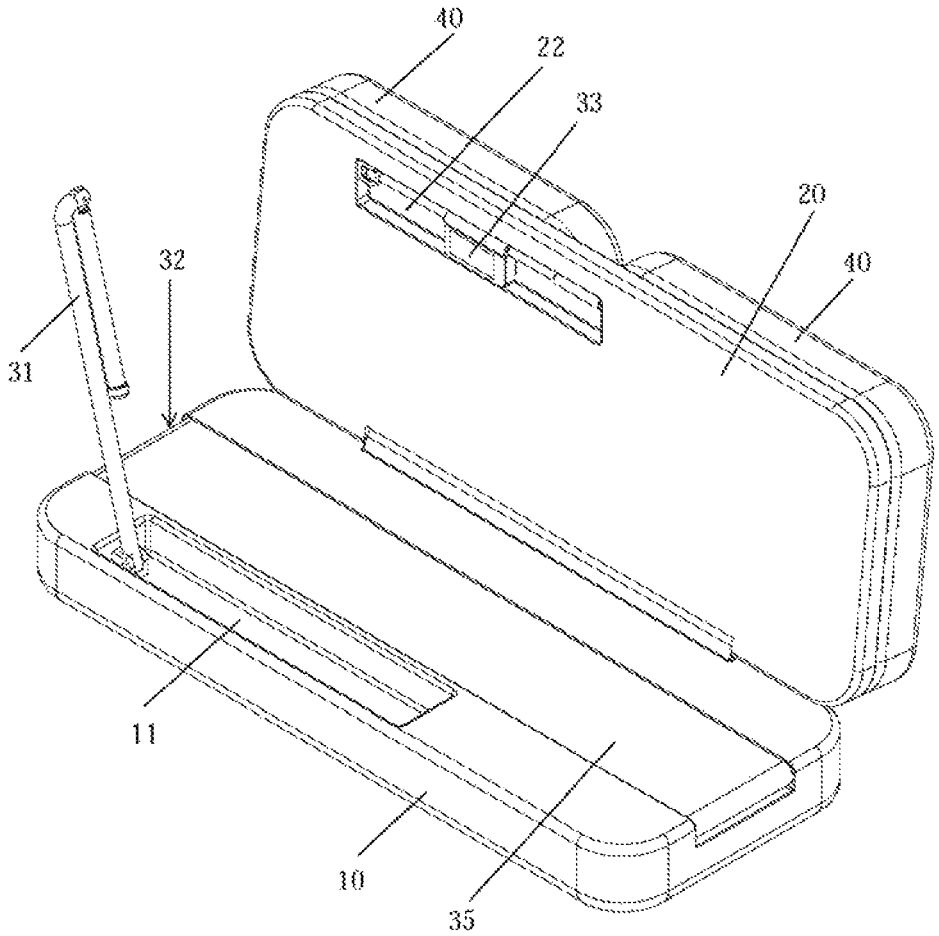
FIG. 5 is a schematic operational view of the exercising device as shown in FIG. 4.
Figure 6:
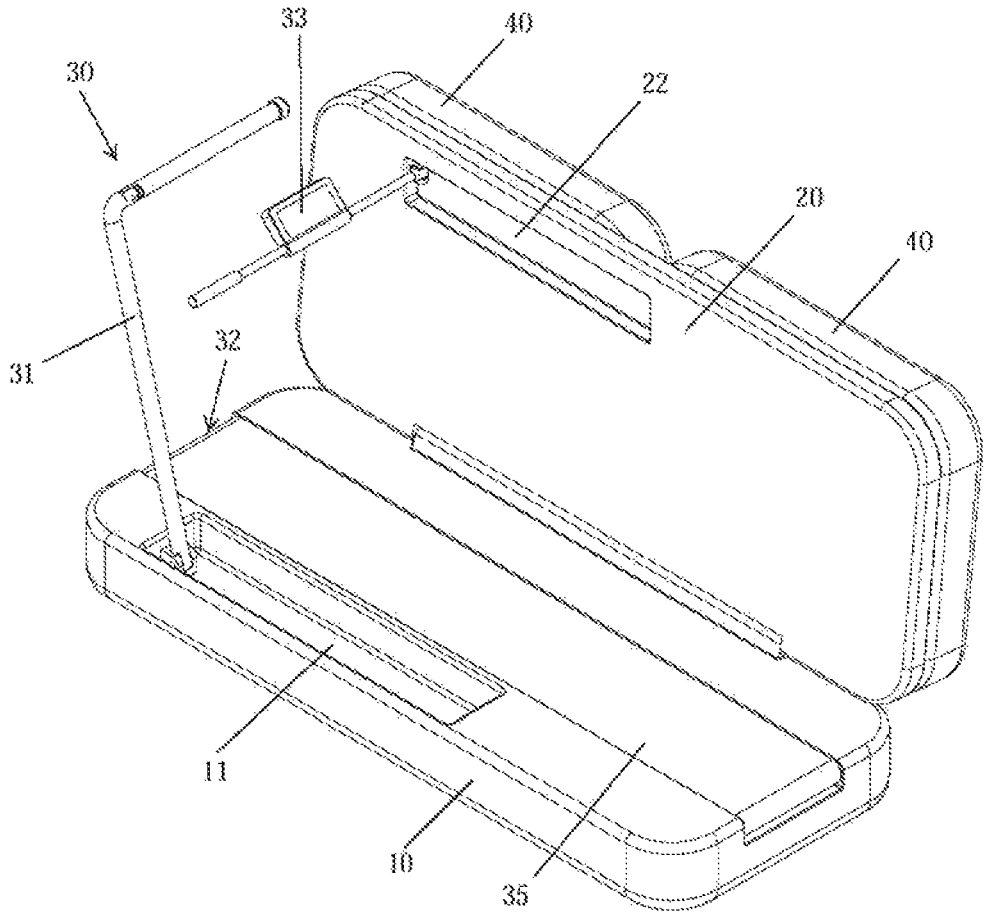
FIG. 6 is a schematic operational view of the exercising device as shown in FIG. 5 in use.

Referring to FIGS. 4-6, the exercise apparatus 30 further includes a hand working unit 31 mounted on the base 10 and located beside the leg working unit 32. The base 10 is provided with a receiving slot 11 located beside the leg working unit 32, and the hand working unit 31 is mounted in the receiving slot 11 of the base 10. The hand working unit 31 is pivotally connected with the base 10. The hand working unit 31 is folded and received in the receiving slot 11 of the base 10, or unfolded and extended outward from the receiving slot 11 of the base 10.

In operation, referring to FIGS. 5 and 6 with reference to FIG. 4, the cover 20 is pivoted outward from the base 10, to expose the hand working unit 31 and the electronic instrument 33. Then, the electronic instrument 33 is unfolded and extended outward from the receiving recess 22 of the cover 20, while the hand working unit 31 is unfolded and extended outward from the receiving slot 11 of the base 10 as shown in FIG. 6. Thus, the user's hands hold the hand working unit 31, and the user's feet wear skis and move on the rotary belt 35 of the leg working unit 32, to simulate a skiing movement. When not in use, the electronic instrument 33 is folded and received in the receiving recess 22 of the cover 20, and the hand working unit 31 is folded and received in the receiving slot 11 of the base 10. Then, the cover 20 is pivoted toward the base 10, to close the top face of the base 10, such that the leg working unit 32 and the electronic instrument 33 are covered and stored. Thus, the exercise apparatus 30 is folded and stored. In addition, the at least one cushion 40 is exposed outward after the cover 20 covers the base 10 as shown in FIG. 4, such that the exercising device is disposed at a furniture status and functions as a seat or a bed.

Figure 7:
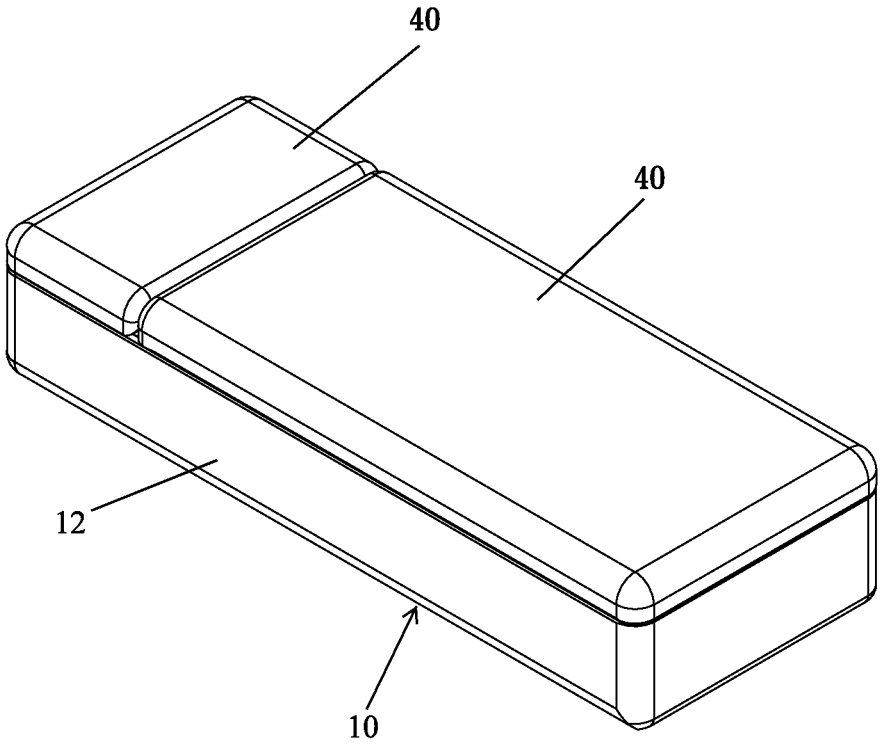
FIG. 7 is a perspective view of an exercising device in accordance with the third preferred embodiment of the present invention.
Figure 8:
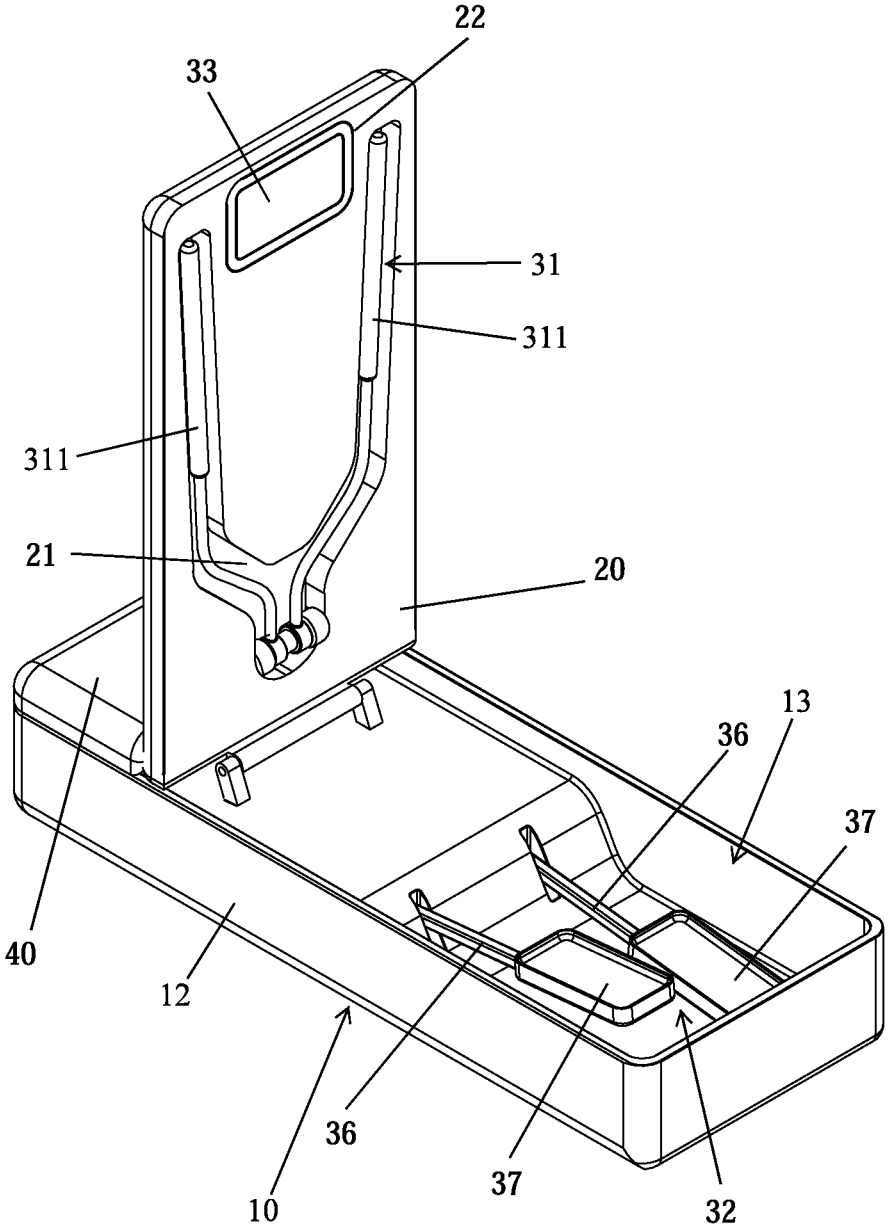
FIG. 8 is a schematic operational view of the exercising device as shown in FIG. 7.
Figure 9:
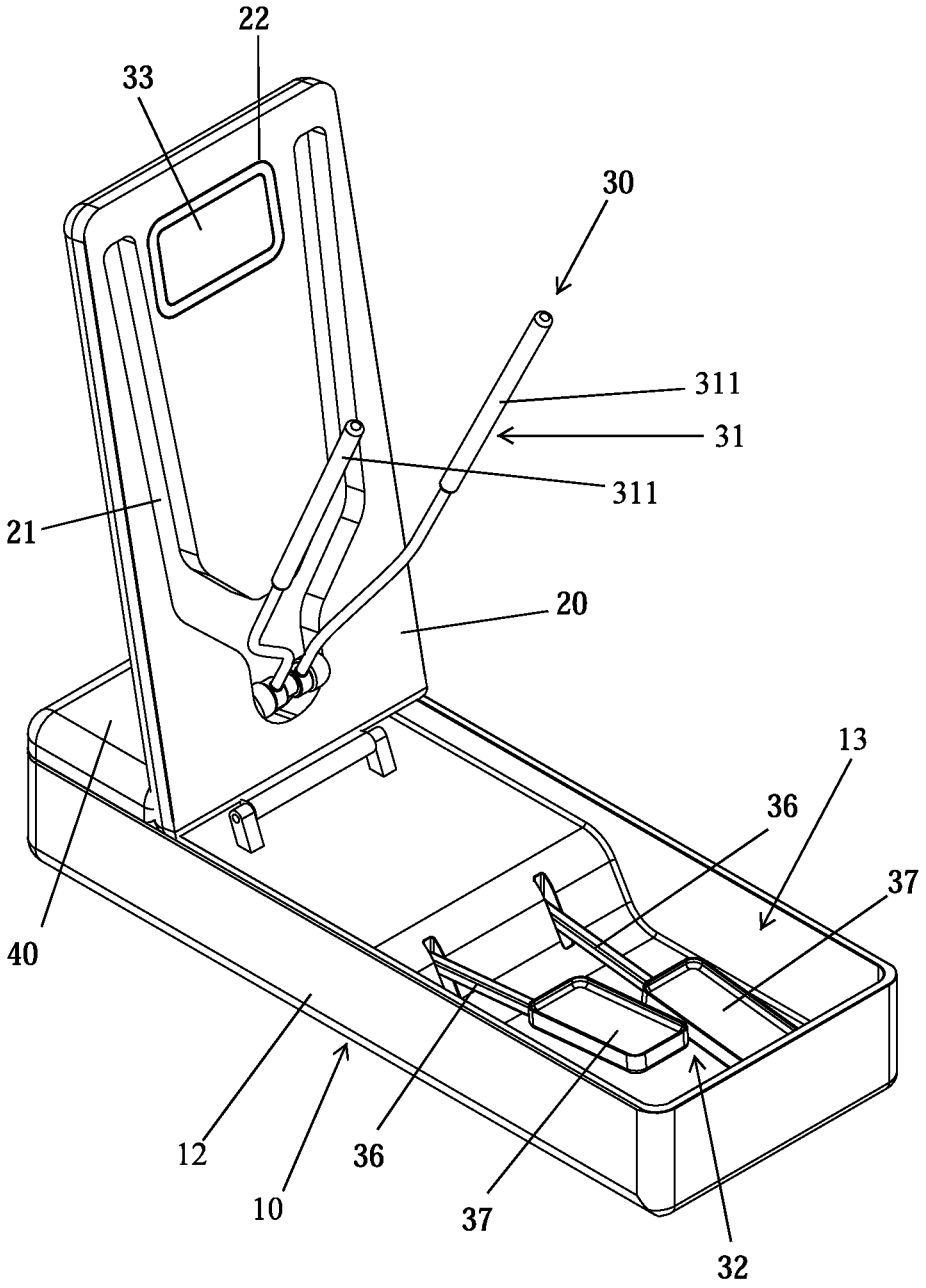
FIG. 9 is a schematic operational view of the exercising device as shown in FIG. 8 in use.

Referring to FIGS. 7-9, the leg working unit 32 includes two operation members (or levers) 36 pivotally connected with the base 10, and two pedals 37 mounted on the two operation members 36 respectively. Preferably, the leg working unit 32 is a stair stepper or an elliptic exercise machine. Thus, the user treads and moves on the two pedals 37. The two operation members 36 are pivoted and moved upward and downward reciprocally. The hand working unit 31 is mounted on the cover 20 and located opposite to the leg working unit 32. Preferably, the hand working unit 31 is mounted on the inner face of the cover 20. The inner face of the cover 20 is provided with a receiving groove 21, and the hand working unit 31 is mounted in the receiving groove 21 of the cover 20. The hand working unit 31 is pivotally connected with the cover 20. The electronic instrument 33 is folded and received in the receiving groove 21 of the cover 20 as shown in FIG. 8, or unfolded and extended outward from the receiving groove 21 of the cover 20 as shown in FIG. 9. The hand working unit 31 and the leg working unit 32 cooperate with each other and are operated mutually. In the preferred embodiment of the present invention, the base 10 has an interior provided with a receiving space 13. The base 10 has an upright peripheral wall 12 surrounding the receiving space 13. The exercise apparatus 30 is a stair stepper including the hand working unit 31 and the leg working unit 32. The hand working unit 31 includes two handles 311 pivotally mounted on the cover 20. The leg working unit 32 is received in the receiving space 13 of the base 10. Thus, the user holds the two handles 311 of the hand working unit 31 and steps the two pedals 37 of the leg working unit 32 to achieve an exercising effect.

In operation, referring to FIGS. 8 and 9 with reference to FIG. 7, the cover 20 is pivoted outward from the base 10, to expose the hand working unit 31 and the leg working unit 32 as shown in FIG. 8. Then, the hand working unit 31 is unfolded and extended outward from the receiving groove 21 of the cover 20 as shown in FIG. 9. Thus, the user's hands hold the hand working unit 31, and the user's feet step on the two pedals 37 of the leg working unit 32, to perform a stair stepping movement. When not in use, the hand working unit 31 is folded and received in the receiving groove 21 of the cover 20. Then, the cover 20 is pivoted toward the base 10, to close the top face of the base 10, such that the hand working unit 31, the leg working unit 32 and the electronic instrument 33 are covered and stored. Thus, the exercise apparatus 30 is folded and stored. In addition, the at least one cushion 40 is exposed outward after the cover 20 covers the base 10 as shown in FIG. 7, such that the exercising device is disposed at a furniture status and functions as a seat or a bed.

Accordingly, when the user wishes to use the exercise apparatus 30, the cover 20 is pivoted outward to expose and unfold the exercise apparatus 30, such that the user directly operates the exercise apparatus 30 to achieve an exercising effect, and the exercise apparatus 30 does not occupies additional indoor space. In addition, when the exercise apparatus 30 is folded, the at least one cushion 40 is exposed outward after the cover 20 covers the base 10, such that the exercising device is disposed at a furniture status and functions as a seat or a bed when not in use. Further, when the cover 20 closes the top face of the base 10, the exercise apparatus 30 is covered by the cover 20, to achieve dust-proof and storage functions, and to enhance the lifetime of the exercise apparatus 30. Further, the exercise apparatus 30 is stored easily and conveniently, thereby facilitating the user storing the exercise apparatus 30. Further, the exercising device is adapted to function as furniture, such that the exercising device is incorporated into the house environment, thereby enhancing the aesthetic quality of the house.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An exercising device comprising:

a base placed on a plane;

a cover pivotally connected with the base; and an exercise apparatus mounted between the base and the cover;

wherein:

the base has an interior provided with a receiving space;

the base has an upright peripheral wall surrounding the receiving space;

the cover has a side pivotally mounted on a side of the base;

the cover is pivoted relative to the base to open or close an open top edge of the base;

the exercise apparatus is a stair stepper;

the exercise apparatus includes a leg working unit mounted on the base and a hand working unit mounted on the cover and located opposite to the leg working unit;

the leg working unit includes two operation members pivotally connected with the base, and two pedals mounted on the two operation members respectively;

the hand working unit includes two handles pivotally mounted on the cover;

a user holds the two handles of the hand working unit and steps the two pedals of the leg working unit;

the leg working unit is received in the receiving space of the base;

the hand working unit is mounted on an inner face of the cover;

the inner face of the cover is provided with a receiving groove, and the hand working unit is mounted in the receiving groove of the cover;

the hand working unit and the leg working unit cooperate with each other and are operated mutually;

the exercise apparatus further includes an electronic instrument which is mounted on the inner face of the cover and electrically connected with the leg working unit; and the inner face of the cover is provided with a receiving recess, and the electronic instrument is mounted in the receiving recess of the cover.

2. The exercising device of claim 1, further comprising:

two cushions mounted on an outer face of the cover and the base respectively.

3. The exercising device of claim 2, wherein the two cushions are juxtaposed to each other.

4. The exercising device of claim 2, wherein the two cushions are arranged in line with each other.

5. The exercising device of claim 1, wherein the exercise apparatus is fully covered by and hidden in the cover and the upright peripheral wall of the base when the cover closes the open top edge of the base.

6. The exercising device of claim 1, wherein the leg working unit is fully received in the receiving space of the base when the cover opens the open top edge of the base.

7. The exercising device of claim 1, wherein the hand working unit is fully received in the receiving groove of the cover when the cover opens the open top edge of the base.

8. The exercising device of claim 1, wherein the electronic instrument is fully received in the receiving recess of the cover when the cover opens the open top edge of the base.

9. The exercising device of claim 1, wherein the electronic instrument is disposed above the hand working unit when the cover opens the open top edge of the base.

* * * * *